US005818158A

United States Patent [19]

Kim

[11] Patent Number: 5,818,158

[45] Date of Patent: Oct. 6, 1998

[54] DEFLECTION YOKE WITH PIVOTING CORRECTING MAGNET

[75] Inventor: Hoo-Deuk Kim, Pusan, Rep. of Korea

[73] Assignee: Samsung Display Devices Co., Ltd., Tokyo, Japan

[21] Appl. No.: 752,148

[22] Filed: Nov. 19, 1996

[30] Foreign Application Priority Data

Jan. 23, 1996 [KR] Rep. of Korea ..... 96-1388

[51] Int. Cl.[6] ..... H01F 7/00; H01J 29/56

[52] U.S. Cl. ..... 313/440; 313/431; 335/212

[58] Field of Search ..... 313/440, 431, 313/433, 413; 335/213, 299, 212, 298

[56] References Cited

U.S. PATENT DOCUMENTS

Re. 29,150 3/1977 Harten et al. ..... 335/212

4,398,166 8/1983 Bumgardner ..... 335/212

5,075,590 12/1991 Lee ..... 313/412

5,432,401 7/1995 Satoh et al. ..... 313/440

*Primary Examiner*—Sandra L. O'Shea

*Assistant Examiner*—Michael Day

*Attorney, Agent, or Firm*—Leydig, Voit & Mayer, Ltd.

[57] ABSTRACT

A deflection yoke includes a cone-shaped separator, a horizontal deflection coil mounted on an inner surface of the separator, a vertical deflection coil wound on a core mounted on an outer surface of the separator, a magnetic corrector for correcting distortion of a magnetic field formed by the horizontal and vertical deflection coils, and a pivotally adjustable support connecting the corrector to the separator so that the corrector pivots about an axis perpendicular to the central axis of the separator, wherein errors in landing of an electron beam on a screen of a cathode ray tube can be corrected.

6 Claims, 4 Drawing Sheets

DEFLECTION YOKE WITH PIVOTING CORRECTING MAGNET

BACKGROUND OF THE INVENTION

The present invention relates to a deflection yoke and, more particularly, to a deflection yoke having a corrector for correcting distortion of a picture due to poor mounting of the deflection yoke and distortion of a deflection magnetic field.

Generally, a cathode ray tube includes a panel 1 on the inside surface of which a fluorescent film 2 is located, a funnel 3 having a neck portion 4 in which an electron gun 5 is located and a cone portion 6, on which a deflection yoke 7 is mounted, sealingly coupled to the panel 1 as shown in FIG. 1.

In the cathode ray tube constituted as above, a picture is formed when an electron beam emitted from the electron gun 5 and selectively deflected by the deflection yoke 7 is projected onto the fluorescent film 2. To appropriately deflect the electron beam emitted from the electron gun 5, a horizontal deflection coil (not shown) of the deflection yoke 7 forms a pin-cushion shaped magnetic field and a vertical deflection coil (not shown) forms a barrel shaped magnetic field.

In FIG. 2, an embodiment of such a deflection yoke is shown. As shown in FIG. 2, the deflection yoke includes a cone-shaped separator 11, a horizontal deflection coil 12 is mounted on the inner surface of the separator 11 and a vertical deflection coil 13 wound around a core 14 installed on the outer surface of the separator 11.

In the deflection yoke constituted as above, when currents are selectively applied to the horizontal deflection coil 12 and the vertical deflection coil 13, a deflection magnetic field is formed, thereby deflecting the electron beam emitted from the electron gun 5 (FIG. 1).

Distortion of the picture is generated by distortion of the deflection magnetic field and poor connection of the deflection yoke to the cone portion 6 (FIG. 1) of the funnel 3. To correct the distortion of the picture, according to conventional technology, purity magnets (not shown) are installed on the neck portion 4 of the cathode ray tube or the permanent magnet plate or an electromagnet (not shown) is mounted on the deflection yoke.

However, it is impossible to completely correct errors in the landing of the electron beam using purity magnets and it is hard to adaptably correct the distortion of the picture since the permanent magnet is fixed to the deflection yoke.

SUMMARY OF THE INVENTION

It is an object of the present invention to provide a deflection yoke having correcting means which can precisely correct the mislanding of an electron beam.

To achieve the object, there is provided a deflection yoke, comprising a cone-shaped separator, a horizontal deflection coil installed on an inner surface of the separator, a vertical deflection coil wound on a core installed on an outer surface of the separator, correcting means for correcting a distortion of a magnetic field formed in the deflection coils by the magnetic field, and supporting means for pivotally connecting the correcting means to the separator.

BRIEF DESCRIPTION OF THE DRAWINGS

The above objects and advantages of the present device will become more apparent by describing in detail a preferred embodiment thereof with reference to the attached drawings in which.

DETAILED DESCRIPTION OF THE INVENTION

Figure 3A:
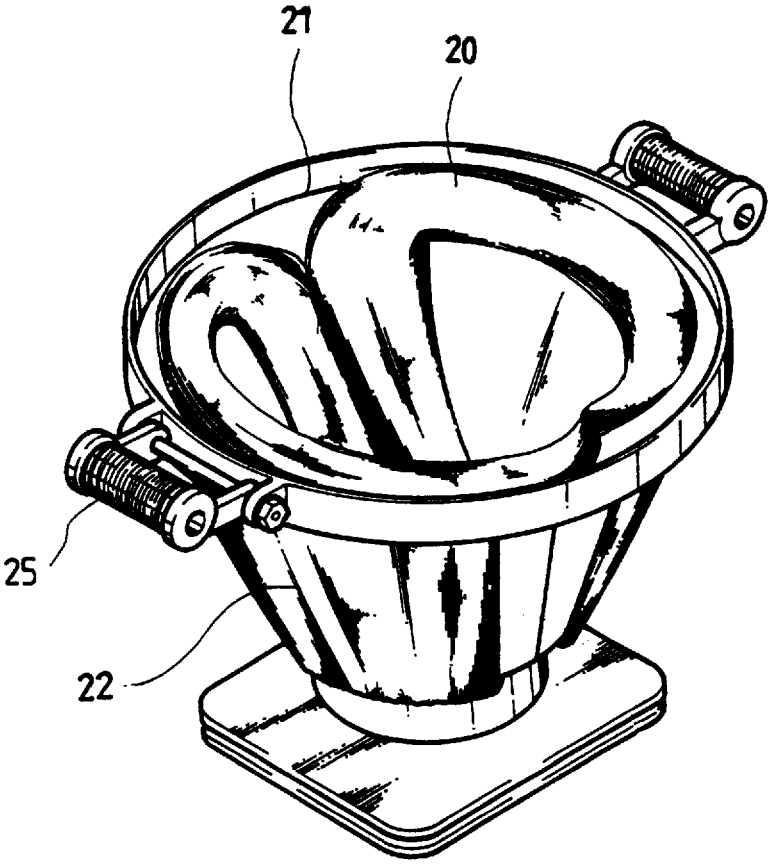
FIG. 3A is a top perspective view of the deflection yoke showing the horizontal deflection coil.
Figure 3B:
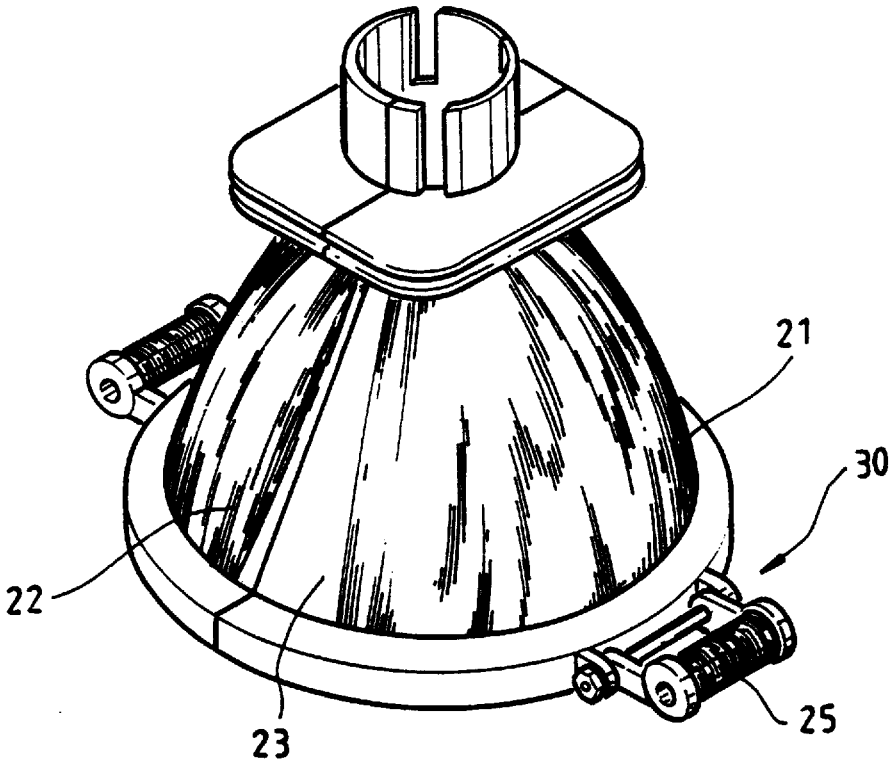
FIG. 3B is a bottom perspective view of the deflection yoke according to the present invention.

Referring to FIGS. 3A and 3B a deflection yoke for a cathode ray tube according to the present invention includes a cone-shaped separator 21, a horizontal deflection coil 20 mounted on an inner surface of the separator 21, and a vertical deflection coil 22 wound on a ferrite core 23 mounted on an outer surface of the separator 21. Also, a correcting means 25 for correcting errors in landing of an electron beam is pivotally connected to the circumference of the separator 21 by a supporting means 30.

Figure 4:
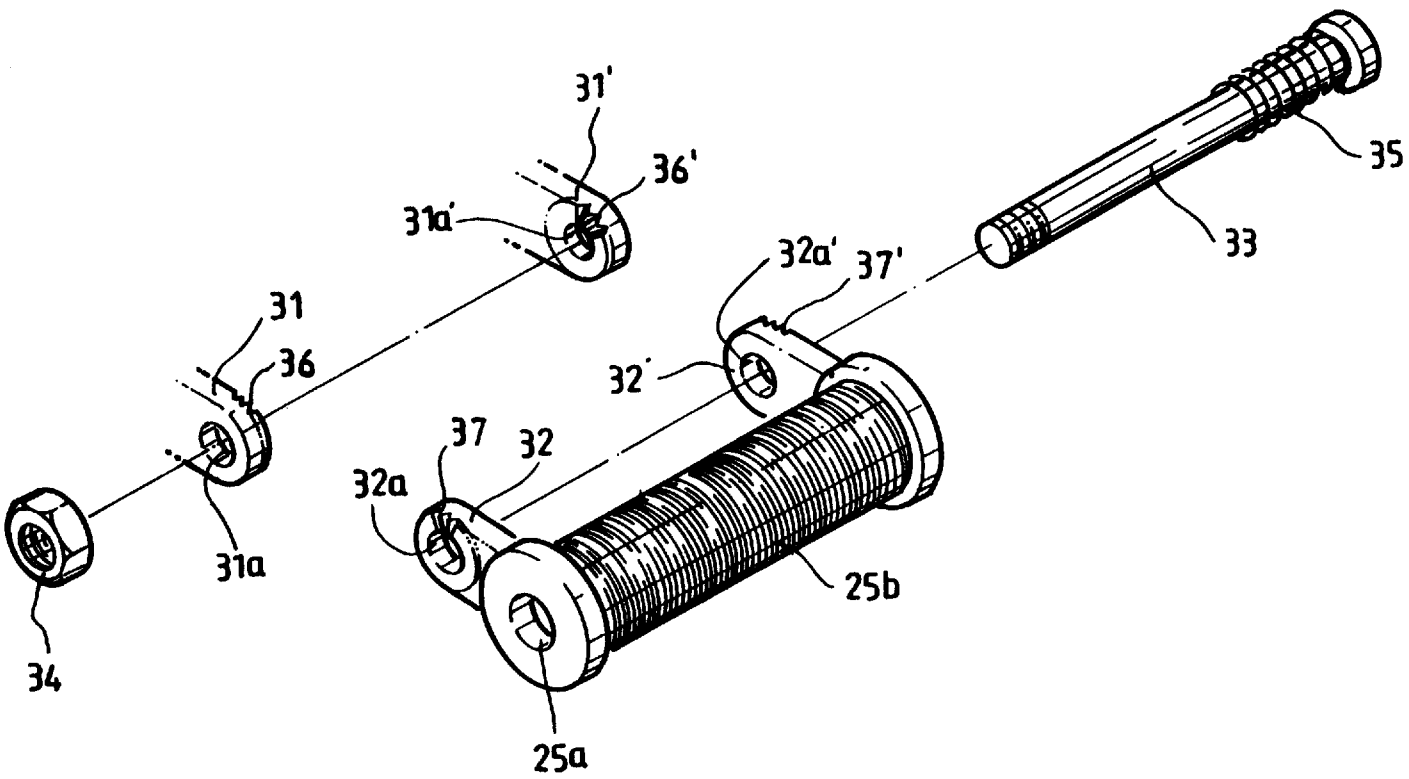
FIG. 4 is a exploded perspective view showing correcting means of the deflection yoke according to the present invention.

Referring to FIG. 4, the correcting means 25 includes a pair of supporting holders 25*a* and a magnet 25*b* installed between the supporting holders 25*a*. An electromagnet or a permanent magnet may be used as the magnet 25*b*.

The supporting means 30 includes a pair of first protrusions 31 and 31' extending from the circumference of the separator 21 and having first holes 31*a* and 31*a*'. A pair of second protrusions 32 and 32' are provided having second holes 32*a* and 32*a*' aligned with the first holes 31*a* and 31*a*' to facilitate attachment of the first protrusions 31 and 31' to the second protrusions 32 and 32'. A bolt 33 is inserted into the first holes 31*a* and 31*a*' and the second holes 32*a* and 32*a*'; the bolt includes a threaded portion. A nut 34 threadedly engages the bolt 33. The contact surfaces of the first protrusions 31 and 31' and the second protrusions 32 and 32' may be knurled to increase friction therebetween. More preferably, complementary radial teeth 36, 36', 37, and 37' may be present on the contact surfaces of first protrusions 31 and 31' and second protrusions 32 and 31'. A spring 35 is preferably disposed around the bolt 33 to further urge the first protrusions 31 and 31' against the second protrusions 32 and 32'.

Figure 1:
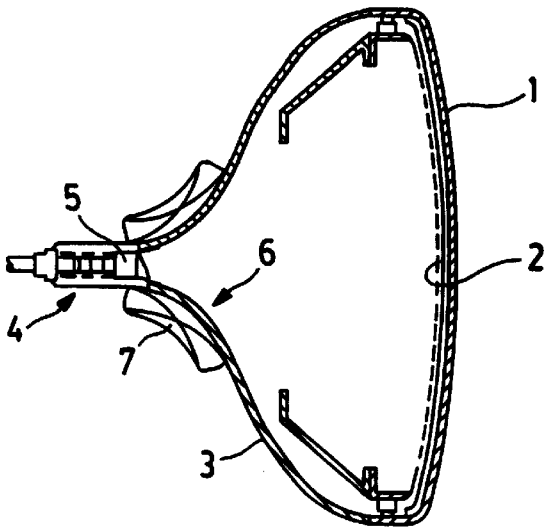
FIG. 1 (PRIOR ART)
FIG. 1 is a sectional view of a general cathode ray tube.
Figure 2:
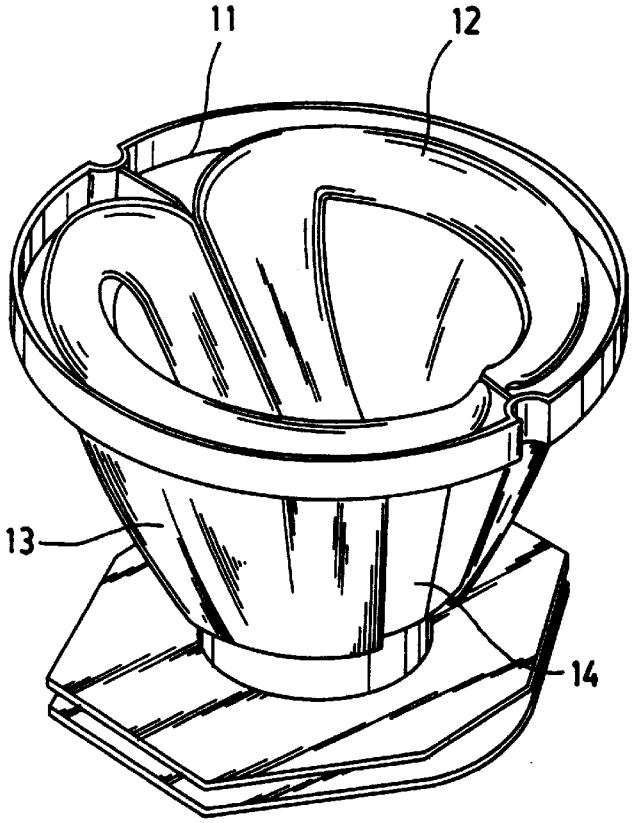
FIG. 2 (PRIOR ART)
FIG. 2 is a perspective view of a conventional deflection yoke.

In the operation of the deflection yoke according to the present invention, when an electron beam emitted from the electron gun 5 (FIG. 1) and deflected is erroneously projected onto the fluorescent film 2, the erroneous projection of the electron beam is corrected by pivoting the correcting means 25 to a correcting position, thereby controlling the deflection magnetic field formed by the deflection yoke. The correcting position of the electron beam is preferably set up according to the degree of error in landing of the electron beam.

Here, since the teeth are located on the contact surfaces of the first protrusions 31 and 31' and the second protrusions 32 and 32', the position of the correcting means 25 can be controlled by moving the correcting means in units of one tooth.

The deflection yoke according to the present invention can prevent the electron beam from landing errors by correction the distortion of the deflection magnetic field. Also, the correcting can easily be made by simply pivoting the correcting means.

The projection corrector, mounted on the separator of the deflection yoke of the present invention, for correcting the erroneous projection of the electron beam emitted from the electron gun is not restricted to the described embodiment, and it is clearly understood that many variations are possible within the scope and spirit of the present invention by anyone skilled in the art.

What is claimed is:

1. A deflection yoke comprising:

a cone-shaped separator having a central axis;

a horizontal deflection coil mounted on an inner surface of said separator;

a vertical deflection coil wound on a core mounted on an outer surface of said separator; and a correcting magnet for correcting distortion of a magnetic field formed by said horizontal and vertical deflection coils and adjustably pivotally mounted on said separator for pivoting about an axis transverse to the central axis.

2. The deflection yoke as claimed in claim 1, wherein said correcting magnet comprises a pair of supporting holders and a magnet disposed between said pair of supporting holders.

3. The deflection yoke as claimed in claim 2, wherein said magnet is an electromagnet.

4. The deflection yoke as claimed in claim 2, including supporting means pivotally connecting said correcting magnet to said separator and comprising:

a pair of first protrusions extending from a circumference of said separator, each of said first protrusions having a first aperture;

a pair of second protrusions respectively extending from said supporting holders, each of said second protrusions having a second aperture respectively aligned with one of the first apertures;

a bolt inserted into the first and second apertures, joining the pairs of first and second protrusions together; and a nut threadedly engaging said bolt.

5. The deflection yoke as claimed in claim 4, wherein the first and second protrusions including contact surfaces, the contact surfaces including complementary radial teeth.

6. The deflection yoke as claimed in claim 2, including supporting means pivotally connecting said correcting magnet to said separator including:

a pair of first protrusions extending from said separator, each of said first protrusions including a first aperture;

a pair of second protrusions, each of said second protrusions extending from said supporting holders and having a second aperture aligned with one of the first apertures; and a coupler engaging and coupling the pairs of first and second protrusions to each other.

* * * * *